US008934794B2

(12) United States Patent
Kubota

(10) Patent No.: US 8,934,794 B2
(45) Date of Patent: Jan. 13, 2015

(54) IMAGE FORMING APPARATUS, STIRRING UNIT AND PROCESS CARTRIDGE

(75) Inventor: Takeshi Kubota, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 137 days.

(21) Appl. No.: 13/433,611

(22) Filed: Mar. 29, 2012

(65) Prior Publication Data

US 2012/0251140 A1 Oct. 4, 2012

(30) Foreign Application Priority Data

Apr. 4, 2011 (JP) ..... 2011-082982
Feb. 17, 2012 (JP) ..... 2012-033416

(51) Int. Cl.
*G03G 15/00* (2006.01)
*G03G 15/08* (2006.01)
*G03G 21/20* (2006.01)

(52) U.S. Cl.
CPC ..... *G03G 15/0846* (2013.01); *G03G 21/206* (2013.01)
USPC ..... 399/44; 399/254

(58) Field of Classification Search
CPC ..... G03G 15/0846; G03G 15/0887
USPC ..... 399/44, 254, 256
See application file for complete search history.

(56) References Cited

U.S. PATENT DOCUMENTS 7,676,167 B2 * 3/2010 Yoshioka et al. ..... 399/254 X
2009/0311009 A1 * 12/2009 Naiki et al. ..... 399/254

FOREIGN PATENT DOCUMENTS

| | | | |
|---|---|---|---|
| JP | 04-134469 A | | 5/1992 |
| JP | 08-044182 | * | 2/1996 |
| JP | 2003-167480 | * | 6/2003 |
| JP | 2003-241624 A | | 8/2003 |
| JP | 2007-058068 A | | 3/2007 |
| JP | 2007-322936 A | | 12/2007 |
| JP | 2009-031770 A | | 2/2009 |
| JP | 2009-063855 A | | 3/2009 |
| JP | 2009-116356 A | | 5/2009 |
| JP | 2011-107623 A | | 6/2011 |

* cited by examiner

*Primary Examiner* — Sandra Brase
(74) *Attorney, Agent, or Firm* — Canon USA Inc IP Division

(57) ABSTRACT

A developer stirring unit is rotated and driven without driving an electrophotographic photosensitive drum according to output information of a temperature detection unit of an image forming apparatus during a non-image formation period, thereby cooling a developer near a developing roller.

12 Claims, 13 Drawing Sheets

NO OPERATION FOR SUPPRESSING DETERIORATION OF TONER

OPERATION FOR SUPPRESSING DETERIORATION OF TONER

IMAGE FORMING APPARATUS, STIRRING UNIT AND PROCESS CARTRIDGE

BACKGROUND OF THE INVENTION

1. Field of the Invention

The present disclosure relates to an image forming apparatus and a process cartridge. Herein, the image forming apparatus forms an image on a recording medium using an electrophotographic image forming process. Examples of the image forming apparatus include an electrophotographic copying machine, an electrophotographic printer (an LED printer and a laser beam printer and the like), and a facsimile machine.

2. Description of the Related Art

In an image forming apparatus using a conventional electrophotographic image forming process, a photosensitive drum and a process unit (for example, a developing unit, a charging unit, a cleaning unit) acting on the photosensitive drum are integrated as a cartridge. A cartridge method is employed, which detachably attaches the cartridge to the main body of the image forming apparatus.

Because the maintenance of this kind of process cartridge in the apparatus can performed by a user himself without depending on a service staff, the operability thereof can be improved. Then, the cartridge method is widely used in an electrophotographic image forming apparatus.

Hereinafter, the conventional image forming apparatus will be described. A cartridge obtained integrally combining a photoreceptor unit with a developing device unit is known as the conventional process cartridge. The photoreceptor unit is obtained by integrally unitizing a photosensitive drum and a cleaning unit and the like. The developing device unit is obtained by unitizing a developing roller and a toner containing container and the like. In this process cartridge, the photoreceptor unit is configured by attaching the photosensitive drum, the charging unit, and the cleaning unit to a drum frame body. The developing device unit is configured by incorporating a developing blade and a toner conveyance stirring unit in addition to the developing roller and the toner containing container. The process cartridge is formed by integrally joining both the side surfaces of the photoreceptor unit and the developing device unit, using a side cover including a ventilation hole, and the like.

In the conventional image forming apparatus, an electrostatic latent image is formed on the photosensitive drum by a charging device and an exposure device and the like. A developer is applied by a developing device, to allow the electrostatic latent image to be a visible image (developer image). The developer image (toner image) is transferred to a transfer material supplied to the photosensitive drum via a feeding unit and a conveyance unit and the like by a transfer device. The transfer material having the transferred toner image is conveyed to a fixing device by the conveyance unit. The toner image is subjected to heating and press-fixing. The transfer material is discharged to the outside of the main body of the image forming apparatus. Rotational drive is input into the photosensitive drum from the main body of the electrophotographic image forming apparatus during image formation operation. The toner conveyance stirring unit is also rotated and driven simultaneously with the rotational drive of the photosensitive drum.

Conventionally, in an electrophotographic image forming apparatus described above, when the internal temperature of the apparatus is remarkably increased, the deterioration of the developer is caused, and good development may not be obtained. To prevent the deterioration of the developer, a cooling fan is provided in the main body of the conventional electrophotographic image forming apparatus, to control the internal temperature increase of the apparatus.

Japanese Patent Application Laid-Open No. 2003-241624 discusses a technique in which airflow around the process cartridge caused by the cooling fan enters into the process cartridge from the ventilation hole of the side cover. The airflow passes through the vicinity of the developing roller, and is exhausted from an exposure window portion (laser opening). The airflow cools the surface of the photosensitive drum and the surface of the developing roller.

However, further size reduction and printing speedup of the electrophotographic image forming apparatus in the above-mentioned conventional technique cause the following problem.

The image forming apparatus includes an air course (airflow) so that air taken in by the cooling fan enters into the process cartridge from the ventilation hole formed in the side cover, passes along the vicinity of the photosensitive drum and the developing roller, and leaks to the exposure window portion (laser opening) and a transfer roller side.

However, the further size reduction and printing speedup of the electrophotographic image forming apparatus can be said to provide an insufficient cooling effect. Long-term or a large quantity of image formation operations increase a temperature of a toner in the developing device and near the developing roller.

The progress of temperature increase is further caused by residual heat from a heating source due to the process that a drive system in the apparatus stops after the image formation operation is completed, which requires a time until the temperature is sufficiently lowered. On this occasion, the deterioration of the toner is caused, and thereby a good image may not be obtained in the subsequent image formation.

SUMMARY OF THE INVENTION

The present disclosure is directed to an image forming apparatus configured to suppress temperature increase of a toner in a developer containing container and near a developing roller due to temperature rise during a non-image formation period.

According to an aspect of the present disclosure, an image forming apparatus is configured to form an image on a recording medium, the image forming apparatus includes a process cartridge detachably attached to an apparatus main body of the image forming apparatus. The process cartridge includes a photosensitive drum; a developing roller configured to develop an electrostatic latent image formed on the photosensitive drum via a developer, a developing container configured to include the developing roller disposed therein, a developer containing container configured to contain the developer and to include an opening portion in communication with the developing container; and a rotatable stirring member provided in the developer containing container to stir the developer and configured to convey the developer contained in the developer containing container to the developing roller and to return the developer of the opening portion to the developer containing container, a temperature detection unit configured to detect an internal temperature of the image forming apparatus, and a control unit configured to perform a control based on temperature information output from the temperature detection unit to drive the stirring member without rotating the photosensitive drum or the photosensitive drum and the developing roller during a non-image formation period.

According to another aspect, a process cartridge configured to be detachably attached to an apparatus main body of an image forming apparatus configured to form an image on a recording medium, the image forming apparatus includes a temperature detection unit configured to detect an internal temperature of the image forming apparatus and a control unit. The process cartridge includes a photosensitive drum; a developing roller configured to develop an electrostatic latent image formed on the photosensitive drum via a developer; a developing container configured to have the developing roller disposed therein, a developer containing container configured to contain the developer and to have an opening portion in communication with the developing container; and a rotatable stirring member provided in the developer containing container to stir the developer and configured to convey the developer contained in the developer containing container to the developing roller and to return the developer of the opening portion to the developer containing container, wherein the control unit drives the stirring member based on temperature information output from the temperature detection unit without rotating the photosensitive drum or the photosensitive drum and the developing roller during a non-image formation period.

Further features and aspects will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles disclosed herein.

DESCRIPTION OF THE EMBODIMENTS

Various exemplary embodiments, features, and aspects of the disclosure will be described in detail below with reference to the drawings.

Figure 2:
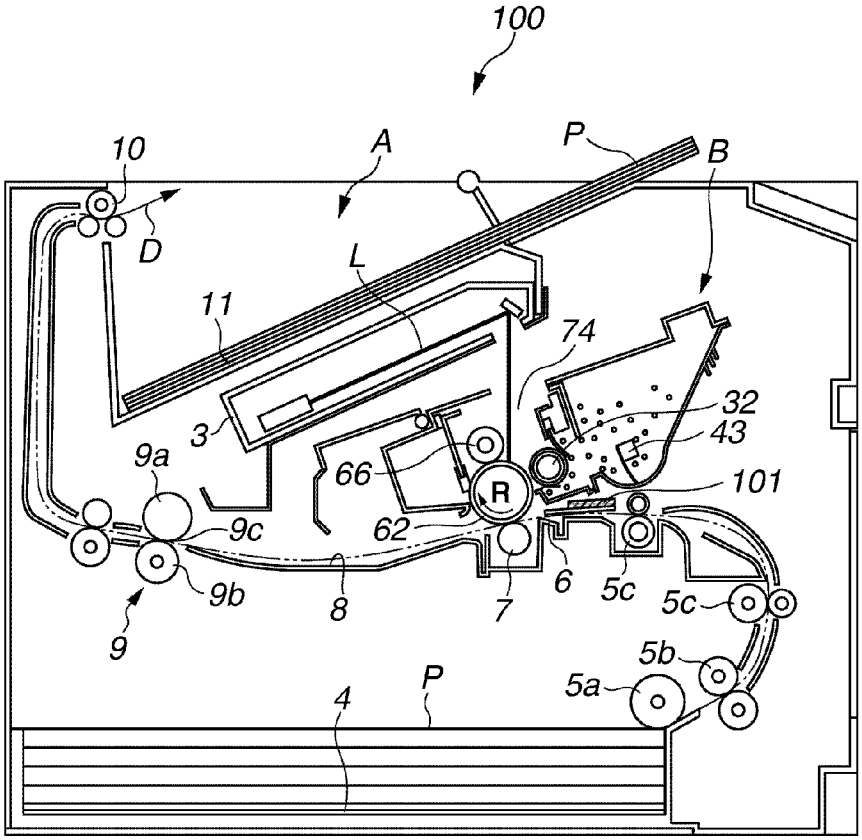
FIG. 2 is a sectional view of an image forming apparatus according to the first exemplary embodiment.
Figure 3:
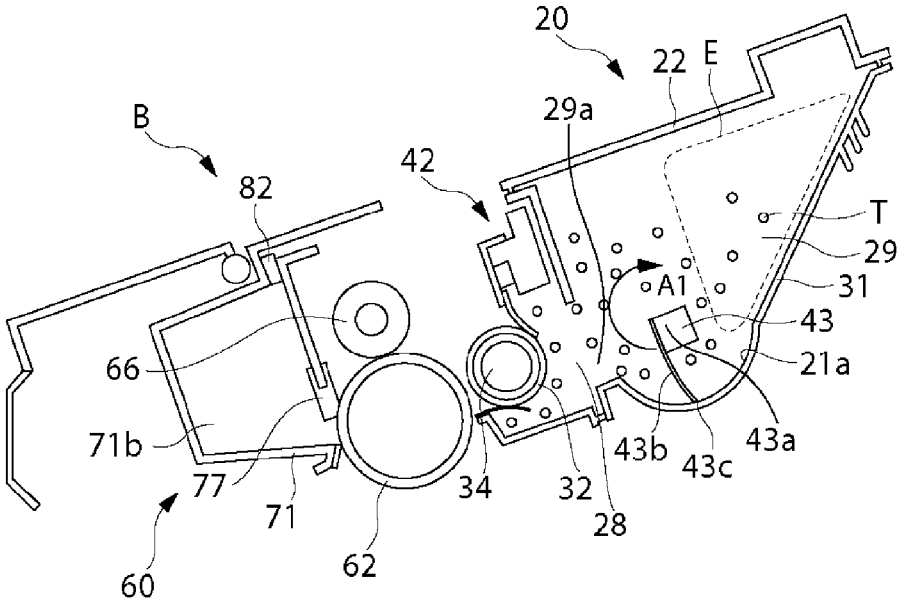
FIG. 3 is a sectional view of a process cartridge according to the first exemplary embodiment.

A first exemplary embodiment will be described. The whole configuration of the first exemplary embodiment and an image forming process will be described using FIGS. 2 and 3. FIG. 2 is a sectional view of an image forming apparatus main body (hereinafter, referred to as an apparatus main body A) and a process cartridge (hereinafter, referred to as a cartridge B) in an electrophotographic image forming apparatus 100 which is an exemplary embodiment of the present invention. FIG. 3 is a sectional view of the cartridge B. Herein, the apparatus main body A is a portion obtained by separating the cartridge B from the electrophotographic image forming apparatus 100.

The whole configuration of the electrophotographic image forming apparatus will be described. In FIG. 2, the electrophotographic image forming apparatus 100 is a laser beam printer having the cartridge B detachably attached to the apparatus main body A and using an electrophotographic technique. When the cartridge B is attached to the apparatus main body A, an exposure device 3 (laser scanner unit) is disposed above the cartridge B. A sheet tray 4 is disposed below the cartridge B. The sheet tray 4 contains a recording medium (hereinafter, referred to as a sheet material P) on which an image is formed.

Figure 6:
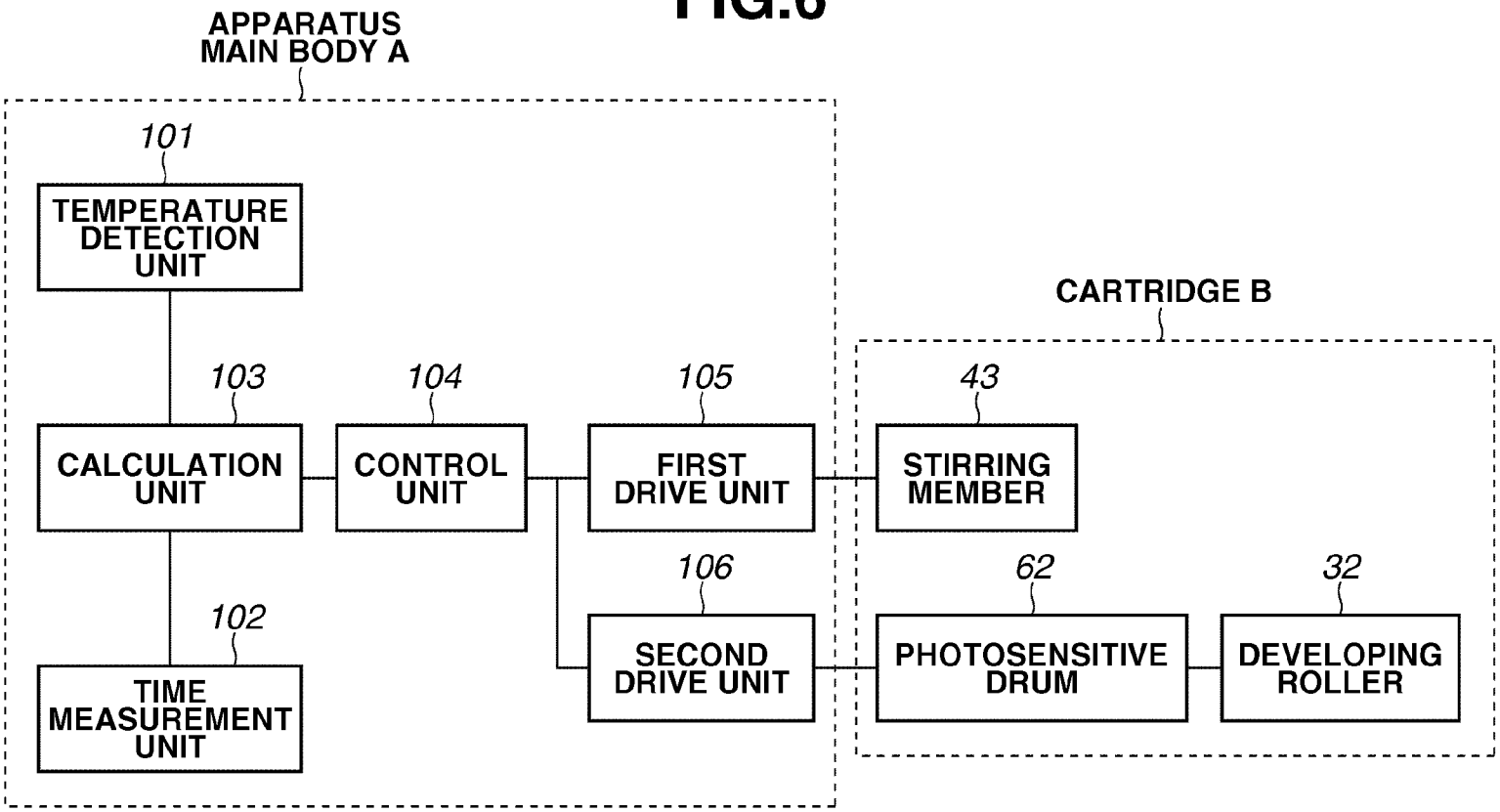
FIG. 6 is a block diagram of a control mechanism according to the first exemplary embodiment.

As illustrated in FIG. 6, the apparatus main body A includes a temperature detection unit 101 configured to measure an internal temperature of the apparatus main body A, a calculation unit 103, a time measurement unit 102, a first drive unit 105, a second drive unit 106, and a control unit 104.

Figure 10:
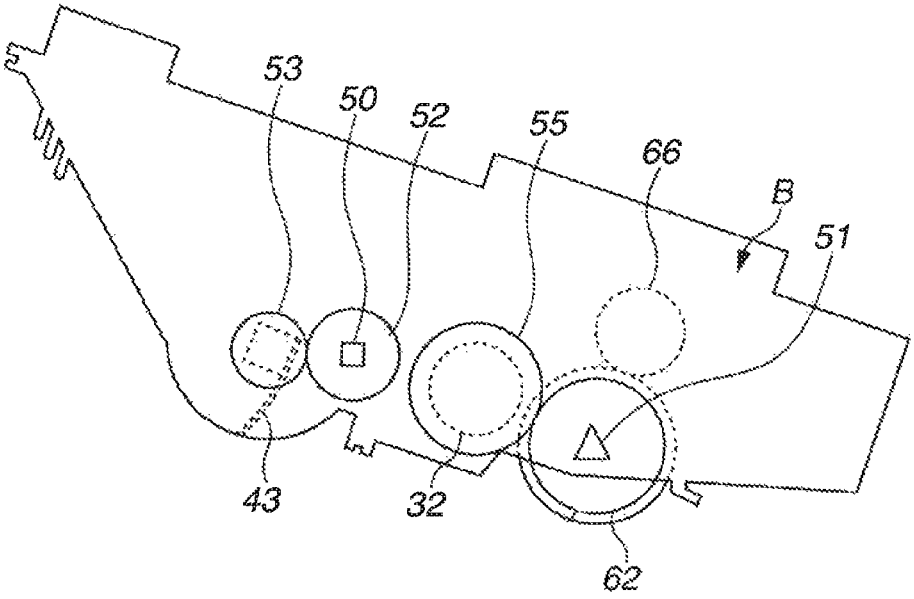
FIG. 10 is a side view of a drive side of the process cartridge according to the first exemplary embodiment.

In addition, in the apparatus main body A, a pickup roller 5*a*, a feeding roller pair 5*b*, a conveyance roller pair 5*c*, a transfer guide 6, a transfer roller 7, a conveyance guide 8, a fixing device 9, a discharging roller pair 10, and a discharging tray 11 are sequentially disposed along the feeding direction D of the sheet material P. The fixing device 9 includes a heating roller 9*a* and a pressing roller 9*b*. To suppress temperature increase of a toner near the developing roller 32, the first drive unit 105 configured to rotate a stirring member 43 is provided separately from the second drive unit 106 configured to rotate a photosensitive drum 62 and the developing roller 32. Specifically, as illustrated in FIG. 10, a first coupling 50 and a second coupling 51 are disposed on the drive side of the cartridge B. When the cartridge B is attached to the apparatus main body A, the first drive unit 105 is connected to the first coupling 50, and the second drive unit 106 is connected to the first coupling 51. A driving force transmitted to the first coupling 50 from the first drive unit 105 is transmitted to the stirring member 43 via a gear 52 in which the first coupling 50 is provided and a gear 53. A driving force transmitted to the second coupling 51 from the second drive unit 106 is transmitted to the photosensitive drum 62, and is transmitted to the developing roller 32 via a gear 52 in which the second coupling 51 is provided and a gear 55.

Next, the outline of the image forming process will be described. The photosensitive drum 62 is rotated and driven in a direction indicated by an arrow R at a predetermined peripheral speed (process speed) based on a print start signal. A charging roller 66 to which a bias voltage is applied is brought into contact with the outer circumferential surface of the photosensitive drum 62, to uniformly charge the outer circumferential surface of the photosensitive drum 62. The exposure device 3 outputs a laser beam L according to image information. The outer circumferential surface of the photosensitive drum 62 is exposed to and scanned by the laser beam L through an exposure window portion 74 of the upper surface of the cartridge B. Thereby, an electrostatic latent image corresponding to the image information is formed on the outer circumferential surface of the photosensitive drum 62.

Meanwhile, as illustrated in FIG. 3, in a developing device unit 20, the stirring member 43 is rotated in a direction indicated by an arrow A1. Thereby, a toner T in a toner chamber 29 as a developer containing container is conveyed to a toner supply chamber 28 as a developing container in which the developing roller 32 is disposed, through an opening portion 29*a* in communication with the toner supply chamber 28 provided in the toner chamber 29. When the stirring member 43 is disposed at a position away from the developing roller 32 at this time, a toner near the developing roller 32 cannot be sufficiently stirred. Then, in the present exemplary embodiment, at least the toner T existing in the opening portion 29*a* is conveyed to a region E which is distant place than the stirring member 43 with respect to the developing roller 32 in the toner chamber 29 by the rotation of the stirring member 43 in the direction indicated by the arrow A1.

Further, the toner T in the region E is conveyed to the opening portion 29*a* and the vicinity of the developing roller 32 by the rotation of the stirring member 43. The stirring member 43 repeats these operations. As illustrated in FIG. 3, in the configuration of the stirring member 43, an elastic sheet 43*b* is provided on a rotatable rotating shaft 43*a* in the toner chamber 29 as the developer containing container. The rotating shaft 43*a* is rotated with a sheet leading edge 43*c* of the sheet 43*b* intruding into an inner wall 21*a* of the toner chamber 29.

Thereby, the toner T is circulated between the toner chamber 29 and the toner supply chamber 28 by the stirring member 43. The toner T is born on the surface of the developing roller 32 by a magnetic force of a magnet roller 34 (stationary magnet). While a developing blade 42 abuts on the developing roller 32 to charge the toner T by friction charging and to regulate the layer thickness of the toner T on the peripheral surface of the developing roller 32. The toner T is transferred to the photosensitive drum 62 according to the electrostatic latent image, and is developed to a visible image as a toner image.

As illustrated in FIG. 2, the sheet material P stored in a lower portion of the apparatus main body A is fed from the sheet tray 4 in accordance with the output timing of the laser beam L by the pickup roller 5*a*, the feeding roller pair 5*b*, and the conveyance roller pair 5*c*. The sheet material P is supplied to a transfer position between the photosensitive drum 62 and the transfer roller 7 via the transfer guide 6. At the transfer position, the toner image is sequentially transferred to the sheet material P from the photosensitive drum 62.

The sheet material P onto which the toner image has been transferred is separated from the photosensitive drum 62, and is then conveyed to the fixing device 9 along the conveyance guide 8. The sheet material P passes through a nip portion 9*c* formed between the heating roller 9*a* and the pressing roller 9*b* which constitute the fixing device 9. The sheet material P is subjected to pressing and heat-fixing processes in the nip portion 9*c*, so that the toner image is fixed on the sheet material P. The sheet material P subjected to process of fixing the toner image is conveyed to the discharging roller pair 10, and is then discharged to the discharging tray 11.

Meanwhile, as illustrated in FIG. 3, the residual toner on the outer circumferential surface of the photosensitive drum 62 after transferring is removed by a cleaning blade 77. Again, the residual toner is used for the image forming process. The toner removed from photosensitive drum 62 is stored in a waste toner chamber 71b of a cleaning unit 60. Because the photosensitive drum 62 and the cleaning blade 77 abut on and rub each other at this time, frictional heat is generated. In the above description, the charging roller 66, the developing roller 32, and the cleaning blade 77 are the process unit acting on the photosensitive drum 62.

Next, a heating source which increases the temperature of the toner in the cartridge B will be described. As for the temperature increase during an image formation period in the cartridge B, frictional heat is generated by each of the contact sliding of the photosensitive drum 62 and the cleaning blade 77, of the developing roller 32 and the developing blade 42, and of the developing roller 32 and a bearing portion thereof. The frictional heat is a heating source which increases the temperature of the toner in the cartridge B. Particularly, the contact sliding between the photosensitive drum 62 and the cleaning blade 77 causes the highest self-temperature increase in the image forming process. The heat is transferred to the surface of the developing roller 32 via the surface of the photosensitive drum 62, and is then transferred to the toner T.

Conventionally, a cooling fan is provided in the apparatus main body and an air trunk (airflow) is formed in the cartridge B, so that the temperature increase of the surface of the photosensitive drum 62 and the surface of the developing roller 32 are controlled.

Figure 4A:
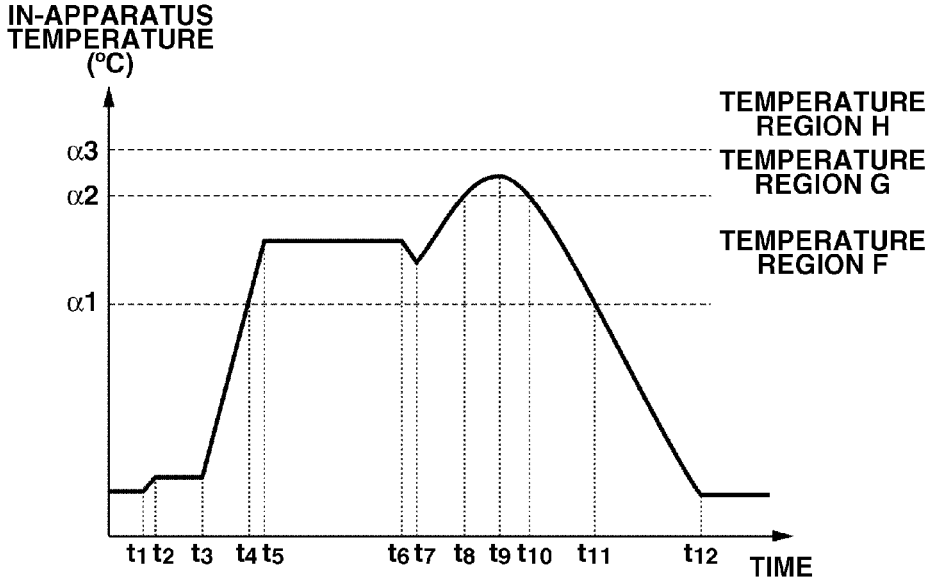
FIGS. 4A and 4B illustrate a change in an internal temperature of the image forming apparatus according to the first exemplary embodiment.

When the image formation operation is completed, the photosensitive drum 62 and the process unit acting on the photosensitive drum 62 stop all at once. However, because insufficient cooling in the airflow causes the residual heat of the heating source, the residual heat causes the further temperature increase in the vicinity of the heating source (FIG. 4A). When the residual heat causes the further temperature increase in the vicinity of the heating source, the toner T in the toner chamber 29 and near the developing roller 32 is aggregated and deteriorated by the heat. The deterioration of the toner may cause fluidity reduction thereof to affect image quality.

Next, operation for suppressing deterioration of the toner will be described. The internal temperature of the apparatus main body A is increased by the image formation operation of the electrophotographic image forming apparatus 100. Furthermore, the residual heat is apt to make the aggregation of the toner T in the toner chamber 29 and near the developing roller 32 progress after the image formation operation is completed. Therefore, when the toner T is continuously left in this state, the deterioration of the toner T may progress. To prevent the deterioration of the toner caused by the heat, it is effective to cool the heat of the toner T near the developing roller 32. Then, in the present exemplary embodiment as described above, the following operation is performed particularly to suppress the temperature increase of the toner T in the toner chamber 29 and near the developing roller 32 after the image formation operation is completed.

When the electrophotographic image forming apparatus 100 performs continuous or many image formation operations, to increase the internal temperature of the apparatus main body A, and temperature information output from the temperature detection unit 101 exceeds a certain temperature, the stirring member 43 is rotated with the rotation of the photosensitive drum 62 and the developing roller 32 stopped. Thereby, a toner T having a comparatively low temperature in the region E in the toner chamber 29 and a toner T having a high temperature near the developing roller 32 in the toner supply chamber 28 and the opening portion 29*a* are mixed, to decrease the temperature and maintain the balance of the temperature. The deterioration of the toner T near the developing roller 32 and the opening portion 29*a* caused by the heat can be suppressed.

Figure 4B:
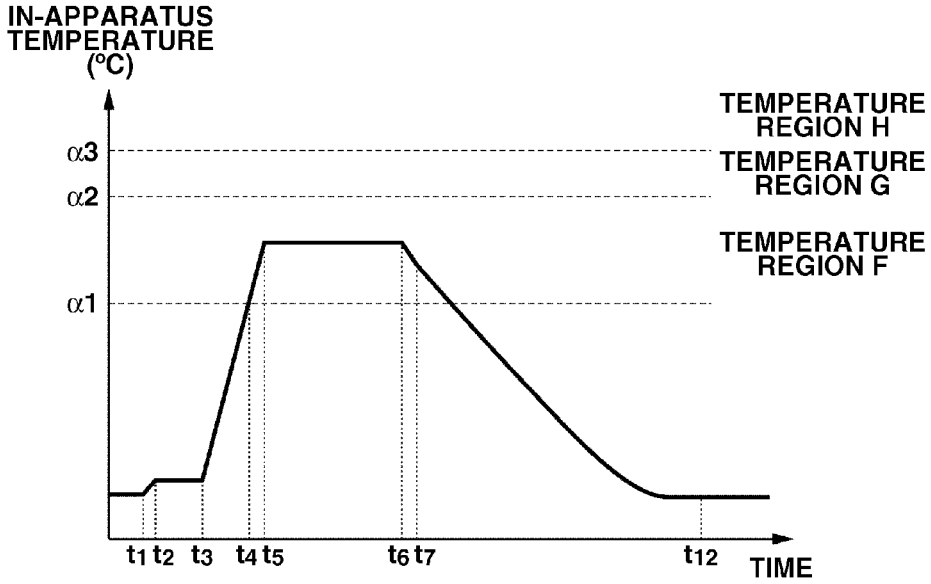

Next, a change in the internal temperature of the apparatus main body A of the electrophotographic image forming apparatus 100 will be described. FIGS. 4A and 4B illustrate the change in the internal temperature of the apparatus main body A.

In the case of no operation for suppressing deterioration of the toner, as illustrated in FIG. 4A, when the power source of the apparatus main body A is turned on at a time $t_1$, electric power is supplied to an electric circuit in the apparatus main body A. The apparatus main body A is in a state where the apparatus main body A can be operated at a time $t_2$, in other words, in a standby state. When the image formation operation is started at a time $t_3$, electric power is supplied to an electrical substrate (not shown), a drive system motor (not shown), and the fixing device 9 in the apparatus main body A. Thereby, the heat generation of the electrical substrate is caused, and particularly the heat generation of the fixing device 9 is remarkably caused to increase the internal temperature of the apparatus main body A and the temperature of the heating source of the above-mentioned image forming process portion (between the time $t_3$ and a time $t_6$).

When the internal temperature of the apparatus main body A is increased to a certain temperature, the internal temperature of the apparatus main body A is kept constant thereafter by the action of a fan provided in the apparatus main body A (between a time $t_5$ and the time $t_6$). When the image formation operation is stopped at the time $t_6$, electric power supply to the electrical substrate, the drive system motor, and the fixing device 9 in the apparatus main body A is stopped, and the temperature is lowered by the action of the fan provided in the apparatus main body A (between the time $t_6$ and a time $t_7$). When the fan is stopped at the time $t_7$, the temperature is gradually increased by the residual heat of the in-apparatus heat generation portion (between the time $t_7$ and a time $t_9$).

Then, in the case of no image formation operation, the internal temperature of the apparatus main body A is lowered to the temperature during standby (between the time $t_9$ and a time $t_{12}$).

In the case of operation for suppressing deterioration of the toner as illustrated in FIG. 4B, the operation until the time $t_7$ is the same as the above-mentioned operation. The operation for suppressing deterioration of the toner is started at the time $t_7$. The internal temperature is lowered to the temperature during standby by the action of the operation (between the time $t_7$ and the time $t_{12}$).

Figure 5:
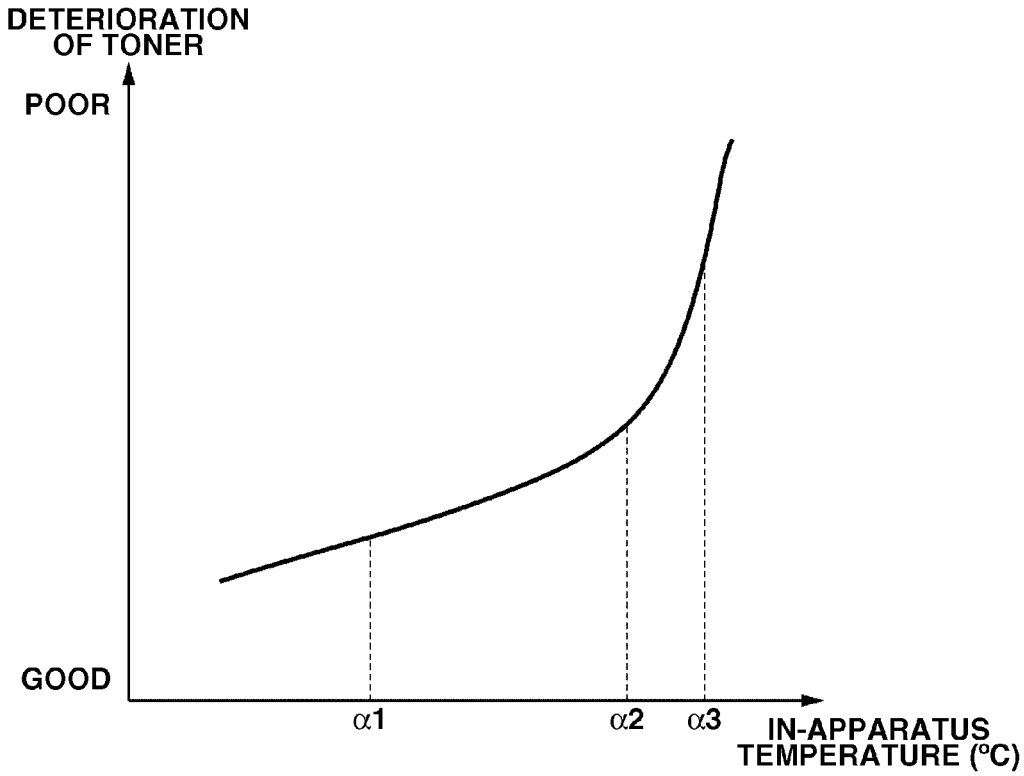
FIG. 5 illustrates an internal temperature of an apparatus main body of the image forming apparatus according to the first exemplary embodiment and a rate of deterioration of a toner.

Next, a temperature region in the apparatus main body A during temperature increase will be described. A temperature region F is set on the basis of temperatures at which the deterioration of the toner T progresses as illustrated in FIG. 5. The range is a region of $\alpha 1°$ C. or higher and lower than $\alpha 2°$ C. In the temperature region F, the progress of the deterioration of the toner may be gradually caused by the temperature increase in the apparatus main body A and the temperature increase of the cartridge B itself (between the time t4 and a time $t_{11}$). A temperature region G is a region of $\alpha 2°$ C. or higher and lower than $\alpha 3°$ C. The progress of the deterioration the toner in the temperature region G is apt to be further caused as compared to that in the temperature region F. The temperature region G is in a severe state (between a time $t_8$ and a time $t_{10}$). A temperature region H means a temperature state higher than that of the temperature region G. It is necessary to promptly perform operation for preventing the deterioration of the toner T in this state. When the operation for suppressing deterioration of the toner is performed, the internal temperature does not exceed the temperature region G. Thereby, the possibility of the deterioration the toner T is reduced to be able to provide a commercial product having little image quality deterioration up to the end of life thereof.

The temperature region is set on the basis of $\alpha 1$ in the present exemplary embodiment. The temperature region is determined by the property of the toner, and can be obtained by performing an experiment. FIG. 6 is a block diagram of a control mechanism configured to control the operation for suppressing the deterioration of the toner. The temperature detection unit 101 always detects the internal temperature of the apparatus main body A, and speculates the temperature of the toner near the developing roller 32.

Temperature information in the apparatus main body A from the temperature detection unit 101 and time information from the time measurement unit 102 are transmitted to the calculation unit 103. A time when the internal temperature of the apparatus main body A is included in the temperature regions F to H (hereinafter, the time is referred to as a high temperature time in the apparatus main body A) is measured by the temperature detection unit 101 to the calculation unit 103. In the case where the image formation operation is completed or is in a standby state, in other words, during a non-image formation period, when the in-apparatus high temperature time to be measured continues for a predetermined time or longer, the deterioration of the toner may be caused. Therefore, the calculation unit 103 gives a command to stop the second drive unit 106 to the control unit 104.

Furthermore, the calculation unit 103 gives a command to drive the first drive unit 105 to the control unit 104. Specifically, the stirring member 43 is rotated while the photosensitive drum 62 and the developing roller 32 are stopped. Thereby, because the stirring member 43 is rotated with the photosensitive drum 62 and the developing roller 32 stopped when the internal temperature of the apparatus main body A exceeds a certain temperature, the deterioration of the toner can be suppressed.

Figure 1:
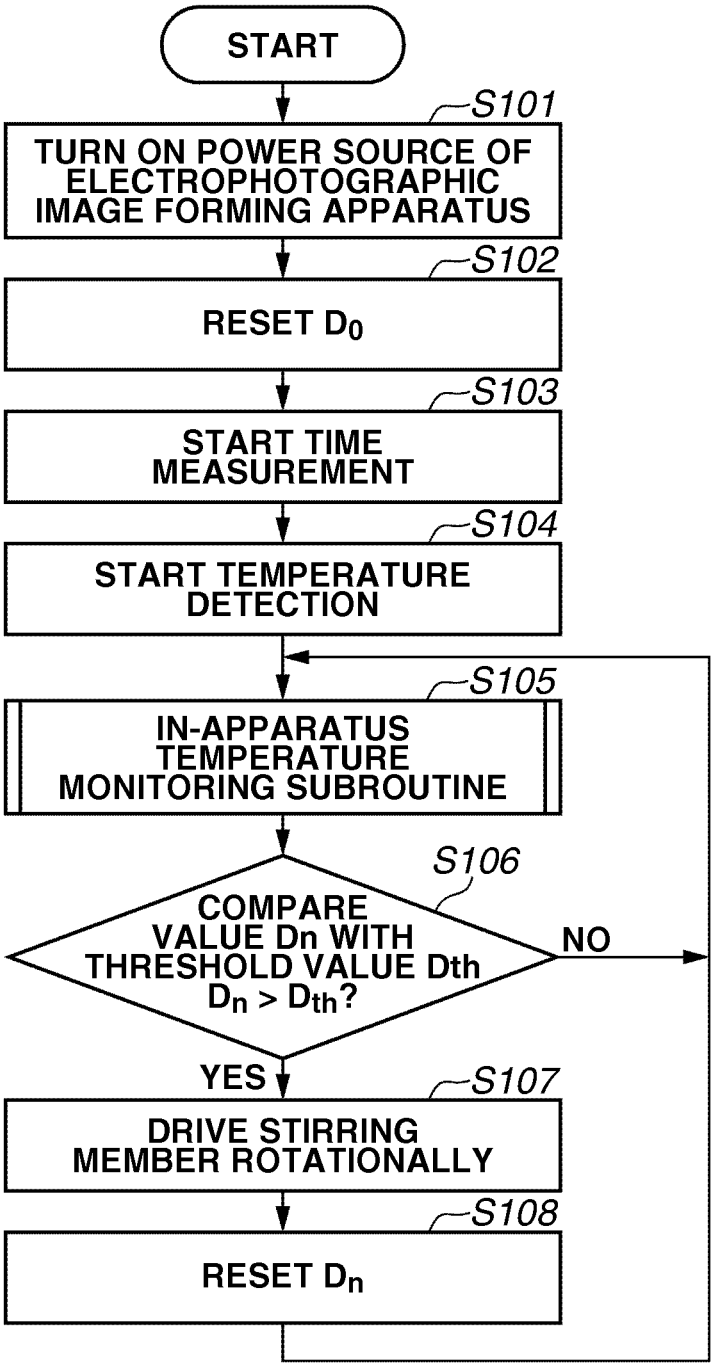
FIG. 1 is a flow for controlling operation for suppressing deterioration of a toner according to a first exemplary embodiment.

Next, a cooling control flow of the image forming process portion will be described using FIG. 1. FIG. 1 is a cooling control flow chart of the image forming process portion. When the power source of the electrophotographic image forming apparatus 100 is turned on as illustrated in FIG. 1 in step S101, in step S102, an initial value $D_0$ of a variable number D for measuring the high temperature time in the apparatus main body A is reset. In step S103 and S104, the temperature detection unit 101 and the time measurement unit 102 start measurement of the time and temperature detection in the apparatus main body A.

In step S105, a temperature monitoring subroutine in the apparatus main body A to be described later measures a time (a high temperature time D in the apparatus main body A) when the internal temperature of the apparatus main body A is in a high temperature state based on the measured time and the internal temperature of the apparatus main body A. In step S106, the control unit 104 determines whether a value $D_n$ obtained by the temperature monitoring subroutine in the apparatus main body A is greater than a predetermined threshold value $D_{th}$. In the case of NO ($D_n \leq D_{th}$) (NO in step S106), the process returns to the temperature monitoring subroutine (S105) in the apparatus main body A again. In the case of YES ($D_n > D_{th}$) (YES in step S106), the control unit 104 determines that the high temperature state continues, to perform the operation for suppressing the deterioration of the toner. In step S107, in the operation for suppressing the deterioration of the toner, first, the rotational drive of the stirring member 43 is started with the photosensitive drum 62 and the developing roller 32 stopped.

As described above, it is directed to stir the toner T having a low temperature in the region E in the toner chamber 29 and the toner T having a high temperature near the developing roller 32 in the toner supply chamber 28 and in the opening portion 29*a*, to balance the temperature of the toner. Therefore, because the temperature of the toner is early brought into a balance state when self-heating is reduced as small as possible, the photosensitive drum 62 and the developing roller 32 as the heating source are stopped. When the operation for suppressing the deterioration of the toner is completed, in step S108, the variable number $D_n$ which measures the high temperature time in the apparatus main body A is reset. The process returns to the temperature monitoring subroutine (S105) in the apparatus main body A again.

Figure 7:
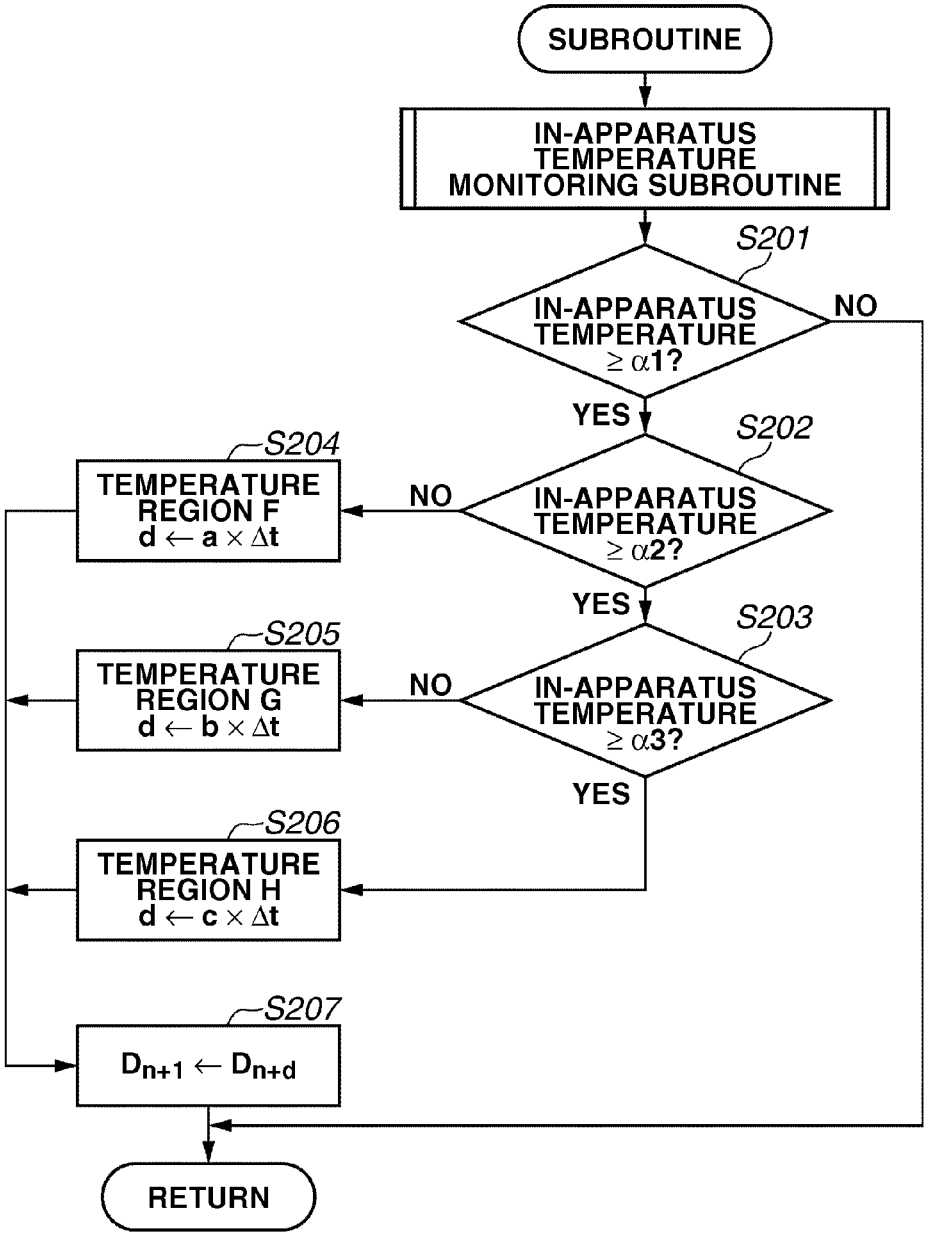
FIG. 7 is a control flow of a temperature monitoring subroutine according to the first exemplary embodiment.

FIG. 7 is a control flow of the temperature monitoring subroutine in the apparatus main body A. As illustrated in FIG. 7, the temperature monitoring subroutine in the apparatus main body A measures a time when the internal temperature of the apparatus main body A is in temperature regions F to H. First, in step S201, the control unit 104 determines whether the internal temperature of the apparatus main body A is $\alpha 1°$ C. or higher.

In the case of NO (NO in step S201) (the internal temperature of the apparatus main body A<$\alpha 1°$ C.), the temperature monitoring subroutine avoids the necessity of measuring the time. In the case of YES (YES in step S201) (the internal temperature of the apparatus main body A≥$\alpha 1°$ C.), in step S202, the control unit 104 determines whether the internal temperature of the apparatus main body A is $\alpha 2°$ C. or higher. In the case of NO (NO in step S201) (the internal temperature of the apparatus main body A<$\alpha 2°$ C.), the internal temperature of the apparatus main body A is included in the temperature region F. At this time, in step S204, the temperature monitoring subroutine measures an elapsed time Δt (a time when the internal temperature of the apparatus main body A is included in the temperature region F), and calculates a corrected elapsed time d from the product of the elapsed time Δt and a correction coefficient a.

In step S202, when the control unit 104 determines YES (YES in step S202) (the internal temperature of the apparatus main body A≥$\alpha 2°$ C.), in step S203, the control unit 104 determines whether the internal temperature of the apparatus main body A is $\alpha 3°$ C. or higher. In the case of NO (NO in step S203) (the internal temperature of the apparatus main body A<$\alpha 3°$ C.), because the internal temperature of the apparatus main body A is included in the temperature region G, in step S205, the corrected elapsed time d is calculated using a correction coefficient b. In the case of YES (YES in step S203), because the internal temperature of the apparatus main body A is included in temperature region H, in step S206, the corrected elapsed time d is calculated using a correction coefficient c.

When the internal temperature of the apparatus main body A is higher, it is necessary to perform the operation for suppressing the deterioration of the toner more quickly. Therefore, the correction coefficients a, b, and c of the temperature regions F to H are desirably set so that the relation of a≤b≤c is satisfied. In step S207, corrected elapsed time d which is calculated as described above is added to the previous high temperature time $D_n$ in the apparatus main body A, to set a high temperature time $D_{n+1}$ in the apparatus main body A.

As described above, according to the present exemplary embodiment, the developer near the developing roller 32 and the opening portion 29*a* and a developer in the region E are circulated after the image formation operation of the electrophotographic image forming apparatus 100 is completed. Thereby, because the whole temperature of the developer in the developing device 20 is in a balance state, the developer near the developing roller 32 can be cooled. The deterioration of the toner T caused by the temperature increase can be suppressed before happens.

The scope of the present invention is not limited to only functions, materials, shapes, and relative configurations and the like of the components described in the present exemplary embodiment as long as they are not specifically described.

Next, a second exemplary embodiment of the present invention will be described with reference to the drawings. In the present exemplary embodiment, portions different from those of the above-mentioned exemplary embodiment will be described in detail. Unless otherwise described again, materials and shapes and the like are the same as those of the above-mentioned exemplary embodiment. The same numbers are assigned to the portions to preclude the necessity for the detailed description thereof.

Figure 8:
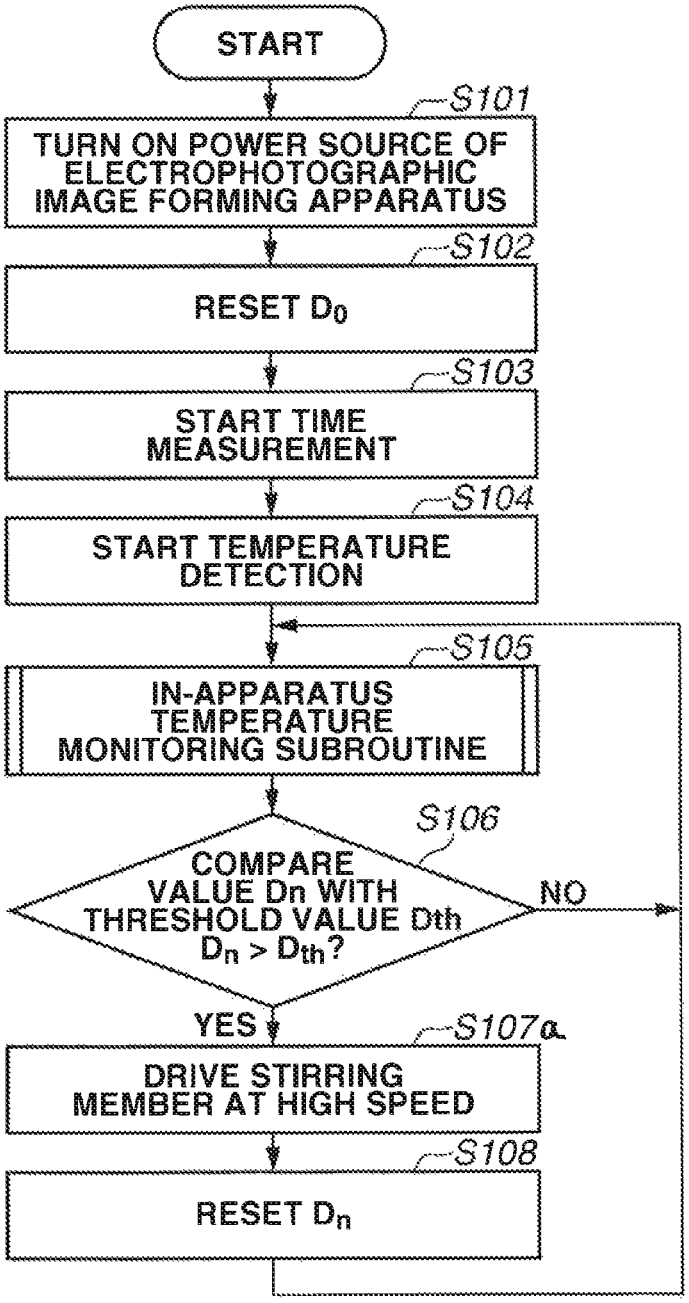
FIG. 8 is a flow for controlling operation for suppressing deterioration of a toner according to a second exemplary embodiment.

FIG. 8 is a block diagram of a control mechanism configured to control operation for suppressing deterioration of a toner according to the present exemplary embodiment. As illustrated in FIG. 8, an electrophotographic image forming apparatus of the present exemplary embodiment performs the operation for suppressing the deterioration of the toner more quickly when the temperature monitoring subroutine (FIG. 7) in the apparatus main body A enters S203 in the electrophotographic image forming apparatus 100 of the first exemplary embodiment. Therefore, a rotational drive system of a stirring member 43 of the apparatus main body A is variably rotated at a higher speed than in an ordinary state (Step S107*a*). Thereby, the toner is circulated at a high speed by rotating the stirring member 43 at a high speed when the internal temperature of the apparatus main body A is higher, to achieve quick cooling, and the deterioration of the toner T can be suppressed.

Figure 9:
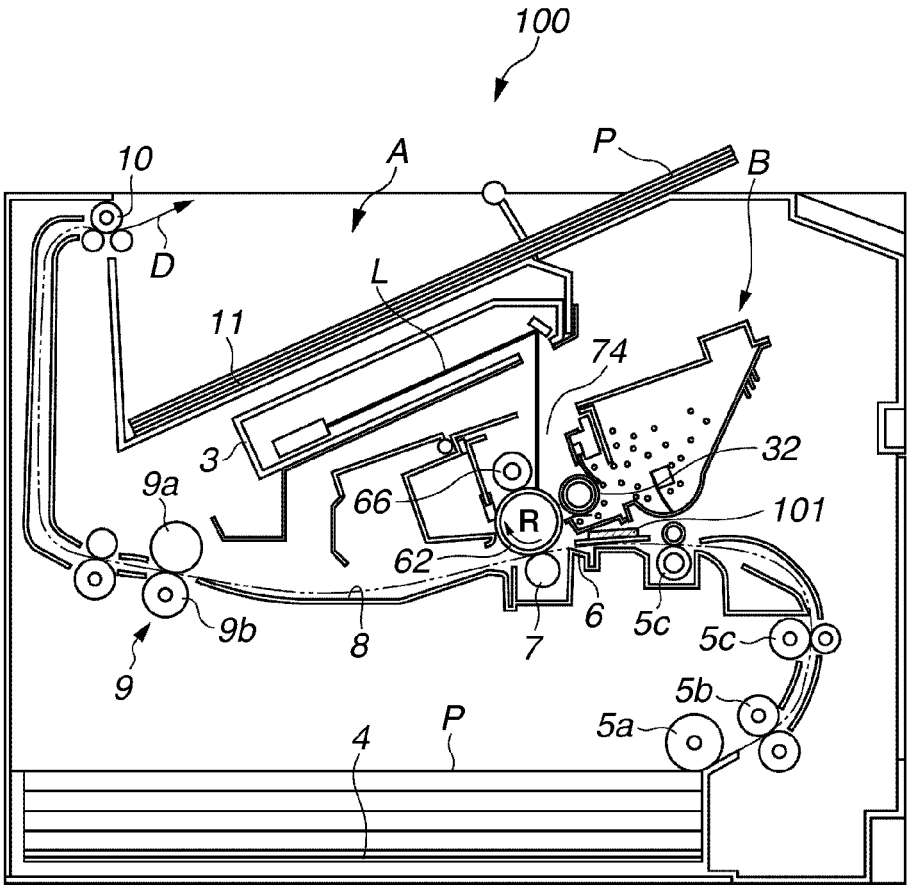
FIG. 9 is a layout drawing of a temperature detection unit according to a third exemplary embodiment.

Next, a third exemplary embodiment of the present invention will be described with reference to the drawings. In the present exemplary embodiment, portions different from those of the above-mentioned exemplary embodiments will be described in detail. Unless otherwise described again, materials and shapes and the like are the same as those of the above-mentioned exemplary embodiments. The same numbers are assigned to the portions to preclude the necessity for the detailed description thereof. FIG. 9 is a layout drawing of a temperature detection unit 101 in a sectional view of an image forming apparatus 100 according to the present exemplary embodiment. As illustrated in FIG. 9, in the electrophotographic image forming apparatus 100 of the present exemplary embodiment, the temperature detection unit 101 always detects the internal temperature of the apparatus main body A in the electrophotographic image forming apparatuses of the first and the second exemplary embodiments. It is more useful to dispose the temperature detection unit 101 near or in a developing device 20 to detect information closer to an atmosphere temperature of a toner.

In FIG. 9, the temperature detection unit 101 is disposed near the developing device 20. Thereby, because the temperature information of the toner is more accurately obtained without time lag, the atmosphere temperature of the toner need not be speculated. Therefore, a time measurement unit can be removed.

Figure 11:
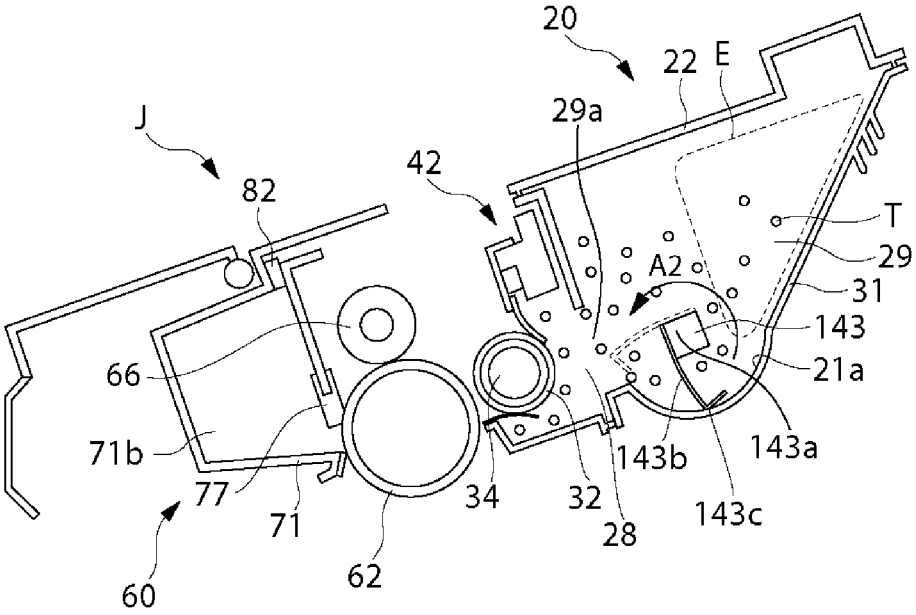
FIG. 11 is a sectional view of a process cartridge according to a fourth exemplary embodiment.

Next, a fourth exemplary embodiment of the present invention will be described with reference to FIG. 10. In the present exemplary embodiment, portions different from those of the above-mentioned exemplary embodiments will be described in detail. Unless otherwise described again, materials and shapes and the like are the same as those of the above-mentioned exemplary embodiments. The same numbers are assigned to the portions to preclude the necessity for the detailed description thereof. FIG. 11 is a sectional view of a process cartridge according to the present exemplary embodiment. As illustrated in FIG. 11, in a process cartridge J of the present exemplary embodiment, a stirring member 143 has a shape different from that of the above-mentioned stirring member. The stirring member 143 has a bending portion 143c in which a leading edge of an elastic sheet 143b as a sheet portion is bent in a forward direction (an upstream side in a rotational direction) with respect to a rotational direction A1 as a usual toner conveyance direction (a rotational direction A1 during an image formation period).

As in the first exemplary embodiment, in operation for suppressing deterioration of a toner, first, the rotational drive of the stirring member 143 is started with a photosensitive drum 62 and a developing roller 32 stopped. However, the stirring member 143 is rotated in a rotational direction A2 opposite to the rotational direction A1. Therefore, the bending portion 143*c* of the leading edge of the elastic sheet 143*b* is bent in a counter direction (a downstream side in the rotational direction) with respect to the rotational direction A2. Therefore, the toner in the opening portion 29*a* is certainly captured by the bending portion 143*c* illustrated by a dotted line in FIG. 11, to convey the toner to a region E farther than the stirring member 143. Thus, the toner in the opening portion 29*a* can be efficiently returned into a toner chamber 29. The other configurations and effects are the same as those of the above-mentioned exemplary embodiments.

Figure 12:
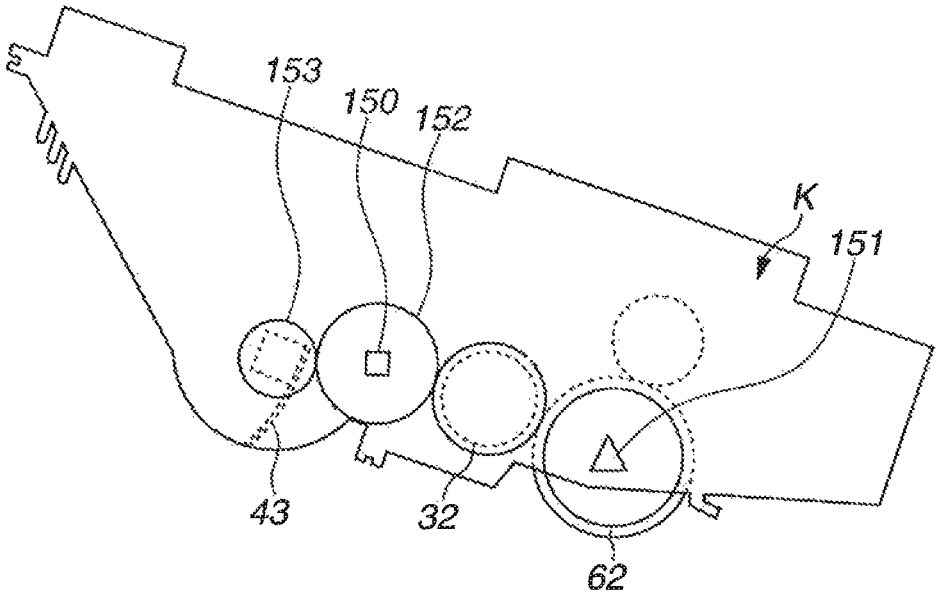
FIG. 12 is a sectional view of a process cartridge according to a fifth exemplary embodiment.
Figure 13:
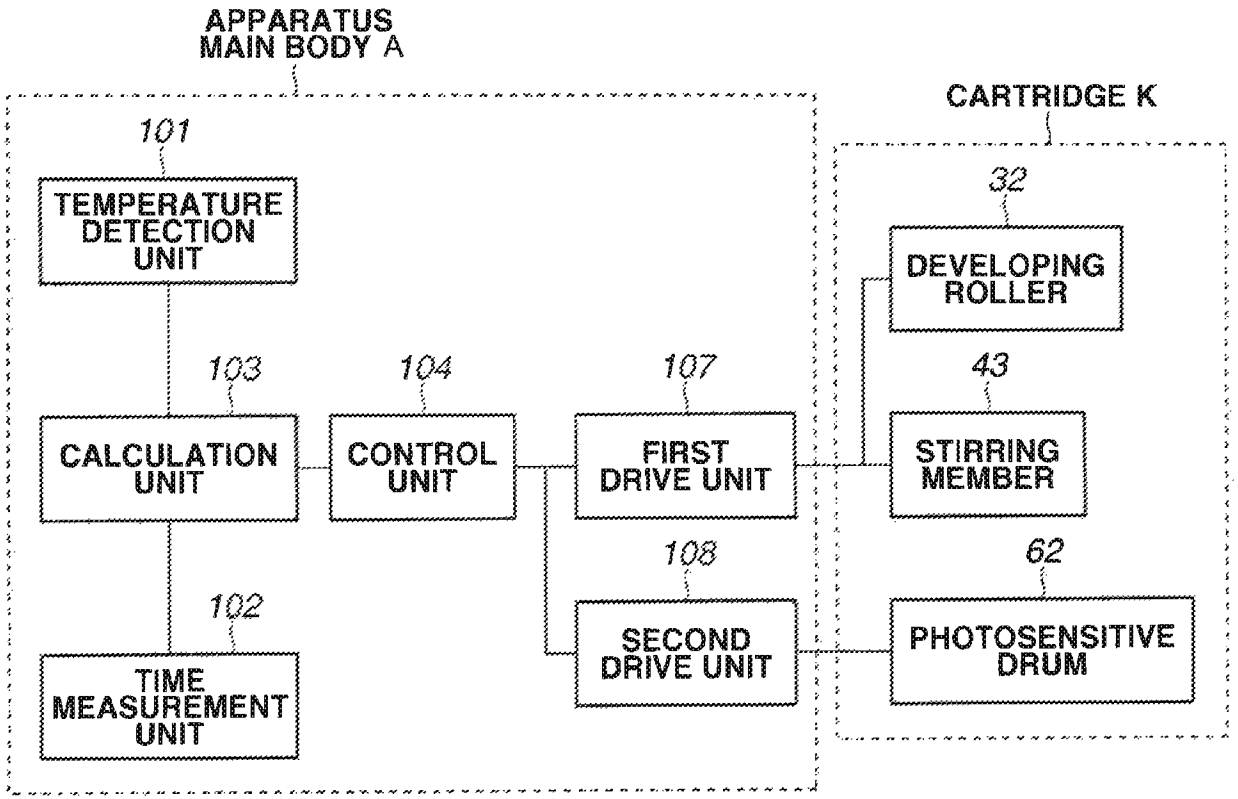
FIG. 13 is a block diagram of a control mechanism according to a fifth exemplary embodiment.

Next, a fifth exemplary embodiment of the present invention will be described with reference to FIGS. 12 and 13. In the present exemplary embodiment, portions different from those of the above-mentioned exemplary embodiments will be described in detail. Unless otherwise described again, materials and shapes and the like are the same as those of the above-mentioned exemplary embodiments. The same numbers are assigned to the portions to preclude the necessity for the detailed description thereof. FIG. 12 is a side view of a drive side of a cartridge K according to the present exemplary embodiment. The apparatus main body A of the first exemplary embodiment includes the first drive unit 105 configured to rotate the stirring member 43 and the second drive unit 106 configured to rotate the photosensitive drum 62 and the developing roller 32. As illustrated in a block diagram of FIG. 13, an apparatus main body A of the fifth exemplary embodiment has a first drive unit 107 configured to rotate the stirring member 43 and the developing roller 32 and a second drive unit 108 configured to rotate the photosensitive drum 62. As illustrated in FIG. 12, a first coupling 150 and a second coupling 151 are disposed on the drive side of the cartridge K. When the cartridge K is attached to the apparatus main body, the first drive unit 107 is connected to the first coupling 150, and the second drive unit 108 is connected to the first coupling 151. A driving force transmitted to the first coupling 150 from the first drive unit 107 is transmitted to a gear 153 and a gear 152 via a gear 52 in which the first coupling 50 is provided, to rotate the stirring member 43 and a developing roller 32. A driving force transmitted to the second coupling 151 from the second drive unit 108 is transmitted to the photosensitive drum 62.

In the above-mentioned configuration, in the case where image formation operation is completed or is in a standby state, in other words, during a non-image formation period, as in the first exemplary embodiment, when the in-apparatus high temperature time to be measured continues for a predetermined time or longer, a calculation unit 103 gives a command to stop the second drive unit 106 to a control unit 104. Furthermore, the calculation unit 103 gives a command to drive the first drive unit 105 to the control unit 104. Specifically, the stirring member 43 and the developing roller 32 are rotated with the photosensitive drum 62 stopped. Thereby, a toner having a temperature increased particularly by the photosensitive drum 62 is circulated to be able to suppress the deterioration of the toner. The other configurations and effects are the same as those of the above-mentioned exemplary embodiments.

As described above, the temperature increase of the toner in the developer containing container and near the developing roller, caused by the temperature increase in the image forming apparatus during the non-image formation period can be suppressed. Thereby, the deterioration of the toner caused by the heat can be suppressed, and a good image can be obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-082982 filed Apr. 4, 2011, and Japanese Patent Application No. 2012-033416 filed Feb. 17, 2012, each of which is hereby incorporated by reference herein in its entirety.

What is claimed is:

1. An image forming apparatus configured to form an image on a recording medium, comprising:

a process cartridge detachably attached to an apparatus main body of the image forming apparatus, the process cartridge comprising:

a photosensitive drum;

a developing roller configured to develop an electrostatic latent image formed on the photosensitive drum via a developer;

a developing container configured to include the developing roller disposed therein;

a developer containing container configured to contain the developer and to include an opening portion in communication with the developing container; and a rotatable stirring member provided in the developer containing container to stir the developer and configured to convey the developer contained in the developer containing container to the developing roller and to return the developer of the opening portion to the developer containing container;

a first coupling configured to receive a driving force for rotating the developing roller and the stirring member from a first drive unit provided in the apparatus main body; and a second coupling configured to receive a driving force for rotating the photosensitive drum from a second drive unit provided in the apparatus main body;

a temperature detection unit configured to detect an internal temperature of the image forming apparatus; and a control unit configured to act on the first drive unit and the second drive unit, wherein the control unit performs a control based on temperature information output from the temperature detection unit to drive the stirring member and the developing roller without rotating the photosensitive drum during a non-image formation period.

2. The image forming apparatus according to claim 1, wherein the stirring member comprises a sheet portion configured to stir the developer and including a leading edge having a bending portion bent upstream, in a rotating direction, where the stirring member is rotated during an image formation period; and wherein the control unit rotates the stirring member in a direction opposite to the rotating direction during the image formation period based on the temperature information output from the temperature detection unit during the non-image formation period.

3. The image forming apparatus according to claim 1, wherein the temperature detection unit is arranged near the developer containing container.

4. An image forming apparatus configured to form an image on a recording medium, comprising:

a developing device comprising:

a developing roller configured to develop an electrostatic latent image formed on a photosensitive drum via a developer;

a developing container configured to include the developing roller disposed therein;

a developer containing container configured to contain the developer and to include an opening portion in communication with the developing container; and a rotatable stirring member provided in the developer containing container to stir the developer and configured to convey the developer contained in the developer containing container to the developing roller and to return the developer of the opening portion to a region farther than the stirring member with respect to the developing roller in the developer containing container in a direction intersecting with an axis of the stirring member;

a temperature detection unit configured to detect an internal temperature of the image forming apparatus; and a control unit configured to perform a control based on temperature information output from the temperature detection unit to drive the stirring member in a direction opposite to a direction in which the stirring member is driven during an image formation period without rotating the photosensitive drum or the photosensitive drum and the developing roller during a non-image formation period.

5. The image forming apparatus according to claim 4, wherein the stirring member comprises a sheet portion configured to stir the developer and including a leading edge having a bending portion bent upstream, in a rotating direction, where the stirring member is rotated during the image formation period.

6. The image forming apparatus according to claim 4, wherein the temperature detection unit is arranged near the developer containing container.

7. A process cartridge configured to be detachably attached to an apparatus main body of an image forming apparatus configured to form an image on a recording medium, the image forming apparatus comprising a temperature detection unit configured to detect an internal temperature of the image forming apparatus and a control unit, the process cartridge comprising:

a photosensitive drum;

a developing roller configured to develop an electrostatic latent image formed on the photosensitive drum via a developer;

a developing container configured to include the developing roller disposed therein;

a developer containing container configured to contain the developer and to include an opening portion in communication with the developing container;

a rotatable stirring member provided in the developer containing container to stir the developer and configured to convey the developer contained in the developer containing container to the developing roller and to return the developer of the opening portion to the developer containing container, a first coupling configured to receive a driving force for rotating the developing roller and the stirring member from a first drive unit provided in the apparatus main body; and a second coupling configured to receive a driving force for rotating the photosensitive drum from a second drive unit provided in the apparatus main body, wherein the control unit configured to act on the first drive unit and the second drive unit drives the stirring member and the developing roller based on temperature information output from the temperature detection unit without rotating the photosensitive drum during a non-image formation period.

8. A process cartridge configured to be detachably attached to an apparatus main body of an image forming apparatus configured to form an image on a recording medium, the image forming apparatus comprising a temperature detection unit configured to detect an internal temperature of the image forming apparatus and a control unit, the process cartridge comprising:

a photosensitive drum;

a developing roller configured to develop an electrostatic latent image formed on the photosensitive drum via a developer;

a developing container configured to include the developing roller disposed therein;

a developer containing container configured to contain the developer and to include an opening portion in communication with the developing container;

a rotatable stirring member provided in the developer containing container to stir the developer and configured to convey the developer contained in the developer containing container to the developing roller and to return the developer of the opening portion to the developer containing container, a first coupling configured to receive a driving force for rotating the developing roller and the stirring member from a first drive unit provided in the apparatus main body; and a second coupling configured to receive a driving force for rotating the photosensitive drum from a second drive unit provided in the apparatus main body, wherein the control unit configured to act on the first drive unit and the second drive unit drives the stirring member and the developing roller based on temperature information output from the temperature detection unit without rotating the photosensitive drum during a non-image formation period wherein the stirring member comprises a sheet portion configured to stir the developer and including a leading edge having a bending portion bent upstream in a rotating direction where the stirring member is rotated during an image formation period; and wherein the control unit rotates the stirring member in a direction opposite to the rotating direction during the image formation period based on the temperature information output from the temperature detection unit during the non-image formation period.

9. The process cartridge according to claim 7, wherein the stirring member comprises a sheet portion configured to stir the developer and including a leading edge having a bending portion bent upstream in a rotating direction where the stirring member is rotated during an image formation period; and wherein the control unit rotates the stirring member in a direction opposite to the rotating direction during the image formation period based on the temperature information output from the temperature detection unit during the non-image formation period.

10. A process cartridge configured to be detachably attached to an apparatus main body of an image forming apparatus configured to form an image on a recording medium, the image forming apparatus comprising a temperature detection unit configured to detect an internal temperature of the image forming apparatus and a control unit, the process cartridge comprising:

a photosensitive drum;

a developing roller configured to develop an electrostatic latent image formed on the photosensitive drum via a developer;

a developing container configured to include the developing roller disposed therein;

a developer containing container configured to contain the developer and to include an opening portion in communication with the developing container; and a rotatable stirring member provided in the developer containing container to stir the developer and configured to convey the developer contained in the developer containing container to the developing roller and to return the developer of the opening portion to a region farther than the stirring member with respect to the developing roller in the developer containing container in a direction intersecting with an axis of the stirring member, wherein the control unit drives the stirring member in a direction opposite to a direction in which the stirring member is driven during an image formation period based on temperature information output from the temperature detection unit without rotating the photosensitive drum or the photosensitive drum and the developing roller during a non-image formation period.

11. The process cartridge according to claim 10, wherein the stirring member comprises a sheet portion configured to stir the developer and including a leading edge having a bending portion bent upstream, in the rotating direction, where the stirring member is rotated during an image formation period.

12. The process cartridge according to claim 10, wherein the temperature detection unit is arranged near the developer containing container.

* * * * *